US007157855B2

(12) United States Patent
Hong et al.

(10) Patent No.: US 7,157,855 B2
(45) Date of Patent: Jan. 2, 2007

(54) PLASMA DISPLAY PANEL

(75) Inventors: Chong-Gi Hong, Suwon-si (KR); Seok-Gyun Woo, Suwon-si (KR); Tae-Kyoung Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/245,018

(22) Filed: Oct. 7, 2005

(65) Prior Publication Data

US 2006/0113911 A1 Jun. 1, 2006

(30) Foreign Application Priority Data

Nov. 29, 2004 (KR) ..... 10-2004-0098744

(51) Int. Cl.
*H01J 17/49* (2006.01)

(52) U.S. Cl. ..... 313/586; 313/585

(58) Field of Classification Search ..... 345/41, 345/60, 65, 67; 315/169.4; 313/581–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A * | 9/1999 | Nanto et al. | 313/584 |
| 5,972,564 | A * | 10/1999 | Kawana et al. | 430/281.1 |
| RE37,444 | E | 11/2001 | Kanazawa | |
| 6,509,689 | B1 * | 1/2003 | Kim et al. | 313/586 |
| 6,630,916 | B1 | 10/2003 | Shinoda | |
| 6,707,436 | B1 | 3/2004 | Setoguchi et al. | |
| 2002/0135545 | A1 * | 9/2002 | Akiba | 345/60 |
| 2004/0245929 | A1 * | 12/2004 | Sakamoto | 313/584 |
| 2005/0099126 | A1 * | 5/2005 | Kim et al. | 313/586 |
| 2005/0242729 | A1 * | 11/2005 | Kweon | 313/586 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

* cited by examiner

OTHER PUBLICATIONS

*"Final Draft International Standard"*, Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Ashok Patel
*Assistant Examiner*—Chris Raabe
(74) *Attorney, Agent, or Firm*—Robert E. Bushnell, Esq.

(57) ABSTRACT

A plasma display panel comprises: a plurality of substrate having a front substrate and a back substrate disposed opposite to each other; dielectric walls disposed between a front surface and a back surface, and defining discharge cells in cooperation with the front substrate and the back substrate; a plurality of discharge electrodes separately disposed around the discharge cells and buried into the dielectric walls; dummy electrodes formed at outer portions of the discharge electrodes disposed in one direction of the substrate and etched when over-etching takes place during the time of developing; and red, green and blue color fluorescent layers coated within the discharge cells.

10 Claims, 6 Drawing Sheets

PLASMA DISPLAY PANEL

CLAIM OF PRIORITY

This application makes reference to, incorporates the same herein, and claims all benefits accruing under 35 U.S.C. § 119 from an application for PLASMA DISPLAY PANEL earlier filed in the Korean Intellectual Property Office on the 29 of Nov., 2004 and there duly assigned Serial No. 10-2004-0098744.

BACKGROUND OF THE INVENTION

1. Technical Field

The present invention relates to a plasma display panel and, more particularly, to a plasma display panel for solving a problem of over-etching by forming a separate dummy electrode pattern in a non-display area, and over-etching the dummy electrode pattern instead of discharge electrodes in order to prevent over-etching of the discharge electrodes arranged in a display area.

2. Related Art

In general, a plasma display panel is a flat display device capable of embodying a desired number, character, or graphic by injecting discharge gas between two substrates in which a plurality of discharge electrodes are formed, and exciting fluorescent materials of the fluorescent layers by ultraviolet rays generated through injection of the discharge gas.

A plasma display panel comprises a front panel and a back panel disposed opposite to the front panel.

The front panel comprises a front substrate, X and Y electrodes disposed on an inner surface of the front substrate, front dielectric layers for burying the X and Y electrodes, and protective films layers formed on the surface of the front dielectric layers.

The X electrodes comprise first transparent electrode lines and first bus electrode lines disposed at one edge of the first transparent electrode lines. The Y electrodes comprises second transparent electrode lines and second bus electrode lines disposed at one edge of the second transparent electrode lines.

The back panel comprises a back substrate, address electrodes disposed on an inner surface of the back substrate and oriented in a direction so as to intersect the X and Y electrodes, and back dielectric layers for burying the address electrodes.

Partitioning walls for dividing a discharge gap are disposed between the front panel and the back panel, and red, green and blue fluorescent layers are coated inside the partitioning walls.

In driving a plasma display panel having the above-mentioned structure, visible rays are emitted from red, green and blue fluorescent layers coated within the selected discharge cells, and a still image or moving image can be embodied when a surface-discharge is generated from a surface of the front panel and ultraviolet rays are generated by applying electrical signals to the Y electrodes and the address electrodes, respectively, selecting discharge cells at the intersecting point, and then alternately applying the electrical signal in the X and Y electrodes.

However, such a plasma display panel has the following problems.

First, the first and second bus electrode lines made of a metal material within the X and Y electrodes can be formed through exposure, developing, and a plastic process after printing a raw material for electrodes on the front substrate.

At this point, a developer is provided at a position adjacent to an edge of the panel in the developing process, and developing solution is coated through the developer.

A high density of the developing solution, a high pressure of a nozzle for coating the developing solution, or a long period of developing time are required to form first and second bus electrode lines having a desired thickness.

However, the first and second bus electrode lines undergo more over-etching than other portions because the edge of the panel adjacent to the direction in which the developer is provided is exposed to the developing solution for a longer period of time than other portions.

Second, transmittance of visible rays generated within the discharge cells does not amount to 60% because the front dielectric layers and the protective film layer, as well as the X and Y electrodes, are sequentially formed on the inner surface of the front substrate. Therefore, the panel does not properly serve as a highly effective flat display.

Third, charged particles of the discharge gas are implanted into the fluorescent layers by an electric field, and a lasting afterimage is generated because the discharge is diffused into the fluorescent layers when driving the plasma display panel for a long period of time.

Fourth, the discharge is diffused outside a discharge gap between the X and Y electrodes. The degree of space utilization is low in the entirety of the discharge cells because the discharge is diffused along a plane of the front panel.

SUMMARY OF THE INVENTION

The present invention provides a plasma display panel capable of preventing the discharge electrodes arranged in a display area from being over-etched by providing a separate dummy electrode pattern in non-display area which is substantially exposed to developing solution, and over-etching the dummy electrode pattern taking into account a phenomenon in which relatively highly exposed portions are over-etched by the developing solution when developing the discharge electrodes.

The present invention further provides a plasma display panel having an improved structure in which transmittance of visible rays is increased by disposing the discharge electrodes around the discharge cells.

According to an aspect of the present invention, there is provided a plasma display panel comprising: a plurality of substrates including a front substrate and a back substrate disposed opposite to each other; dielectric walls arranged between a front surface and a back surface, and defining discharge cells in cooperation with the front substrate and the back substrate; a plurality of discharge electrodes separately disposed around the discharge cells, and buried into the dielectric walls; dummy electrodes formed at outer portions of the discharge electrodes oriented in one direction of the substrate and etched when over-etching takes place during the time of developing; and red, green and blue color fluorescent layers coated within the discharge cells.

The dummy electrodes are, preferably, arranged in a non-display area of the substrate in which first and second discharge electrodes are connected to outside terminals.

The discharge electrodes preferably comprise the first and second discharge electrodes arranged so as to enclose adjacent discharge cells along one direction of the substrate, and the respective first and second discharge electrodes are continuously connected around the adjacent discharge cells.

The dummy electrodes are, preferably, disposed at the outermost portions of a plurality of first and second discharge electrodes continuously arranged in one direction of the substrate.

The dummy electrodes are integrally extended at each edge of the outermost portions.

The dummy electrodes are formed so as to be adjacent to a developer arranged in one direction of the substrate during a developing process, and so as to be formed at outer portions of the first and second discharge electrodes exposed in developing solution for a relatively long period of time.

The first and second discharge electrodes may have a trapezoid shape and are continuously arranged around adjacent discharge cells along one direction of the substrate.

The partitioning walls, defining the discharge cells in cooperation with the dielectric wall, are further provided between the dielectric walls and the back substrate, and the fluorescent layers are coated inside the partitioning walls.

The address electrodes, oriented in a direction so as to intersect the first and second discharge electrodes, are further provided on the back substrate, and the address electrodes are buried by the dielectric layers.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

A plasma display panel according to an embodiment of the present invention will now be described more fully with reference to the accompanying drawings.

Figure 1:
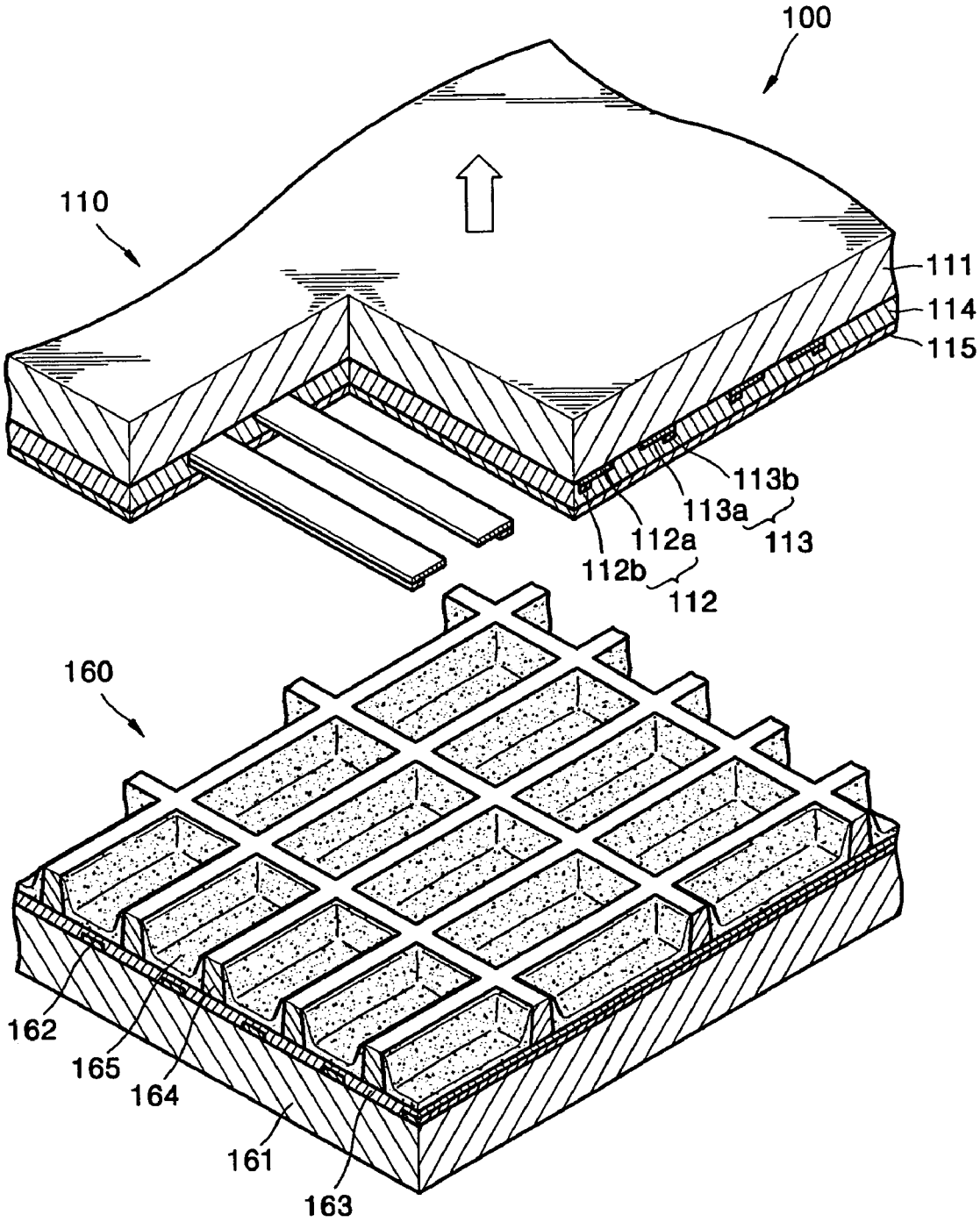
FIG. 1 is an exploded perspective view illustrating a plasma display panel.

FIG. 1 is an exploded perspective view illustrating a plasma display panel.

Referring to FIG. 1, the plasma display panel 100 comprises a front panel 110 and a back panel 160 disposed opposite the front panel 110.

The front panel 110 comprises a front substrate 111, X electrodes 112 and Y electrodes 113 disposed on an inner surface of the front substrate 111, front dielectric layers 114 for burying the X and Y electrodes 112 and 113, respectively, and protective films layers 115 formed on the surface of the front dielectric layers 114.

The X electrodes 112 comprise first transparent electrode lines 112*a* and first bus electrode lines 112*b* disposed at one edge of the first transparent electrode lines 112*a*. The Y electrodes 113 comprises second transparent electrode lines 113*a* and second bus electrode lines 113*b* disposed at one edge of the second transparent electrode lines 113*a*.

The back panel 160 comprises a back substrate 161, address electrodes 162 disposed on an inner surface of the back substrate 161 and oriented in a direction so as to intersect the X and Y electrodes 112 and 113, respectively, and back dielectric layers 163 for burying the address electrodes 162.

Partitioning walls 164 for dividing a discharge gap are disposed between the front panel 110 and the back panel 160, and red, green and blue fluorescent layers 165 are coated inside the partitioning walls 164.

In driving the plasma display panel 100 having the above-mentioned structure, visible rays are emitted from the red, green and blue fluorescent layers 165 coated within the selected discharge cells and a still image or moving image can be embodied when a surface-discharge is generated from a surface of the front panel 110 and ultraviolet rays are generated by applying electrical signals to the Y electrodes 113 and the address electrodes 162, respectively, selecting discharge cells at the intersecting point, and then alternately applying the electrical signal in the X and Y electrodes 112 and 113, respectively.

However, the plasma display panel 100 has the following problems.

First, the first and second bus electrode lines 112*b* and 113*b*, respectively, made of a metal material within the X and Y electrodes 112 and 113, respectively, can be formed through exposure, developing and a plastic process after printing a raw material for electrodes on the front substrate 111. At this point, a developer is provided at a position adjacent to an edge of the panel 100 in the developing process, and developing solution is coated through the developer.

A high density of the developing solution, a high pressure of a nozzle for coating the developing solution, or a long period of developing time are required to form first and second bus electrode lines 112*b* and 113*b*, respectively, of a desired thickness.

However, the first and second bus electrode lines 112*b* and 113*b*, respectively, undergo more over-etching than other portions because the edge of the panel 100, adjacent to the direction in which the developer is provided, is exposed to the developing solution for a longer period of time than other portions.

Second, transmittance of visible rays generated within the discharge cells does not amount to 60% because the front dielectric layers 114 and the protective film layer 115, as well as the X and Y electrodes 112 and 113, respectively, are sequentially formed on the inner surface of the front substrate 110. Therefore, the panel does not serve as a highly effective flat display.

Third, charged particles of discharge gas are implanted into the fluorescent layers 165 by an electric field, and a lasting afterimage is generated because the discharge is diffused into the fluorescent layers 165 when driving the plasma display panel 100 for a long period of time.

Fourth, the discharge is diffused outside a discharge gap between the X and Y electrodes 112 and 113, respectively. The degree of space utilization is low in the entirety of the discharge cells because the discharge is diffused along a plane of the front panel 110.

Figure 2:
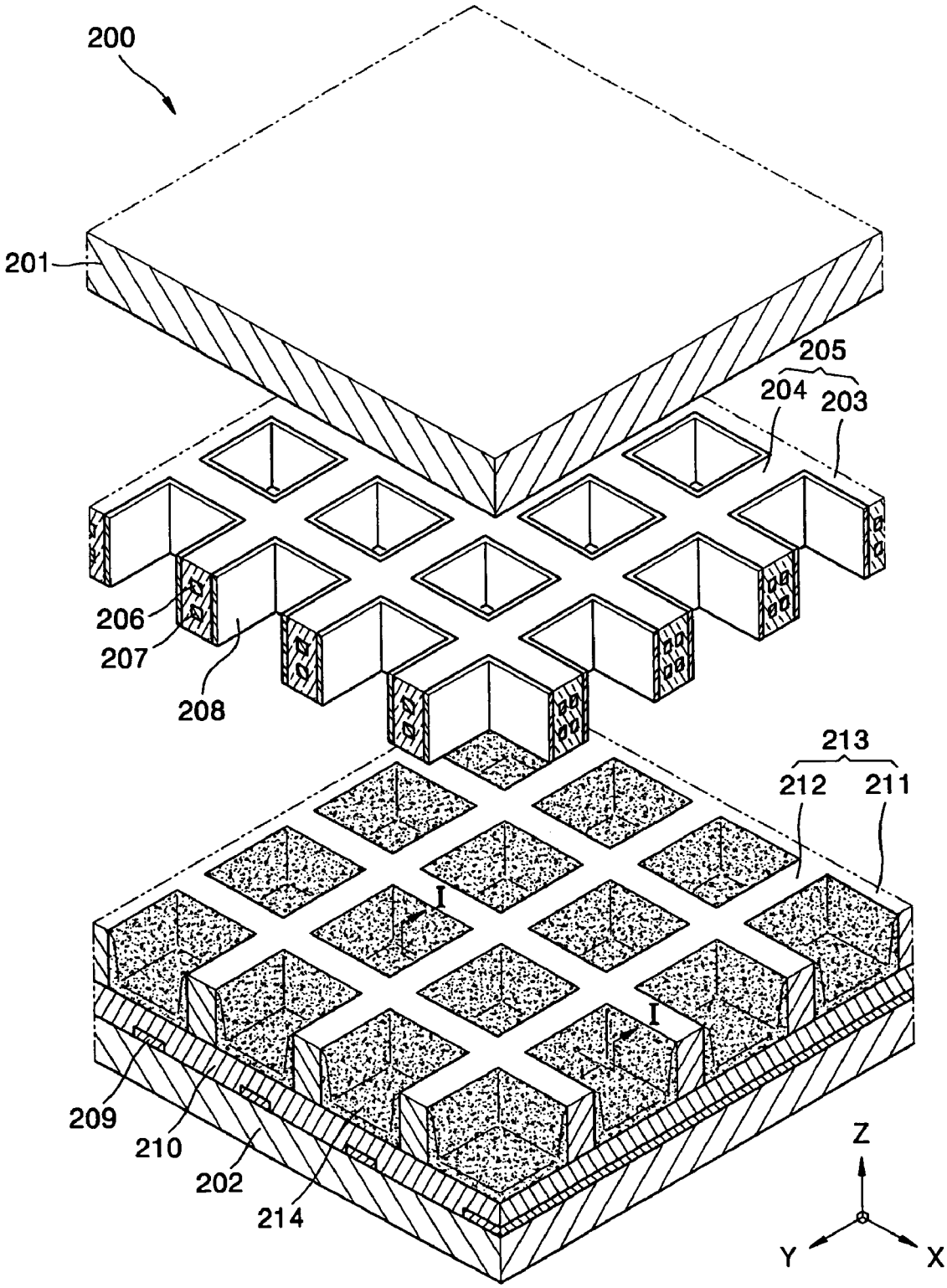
FIG. 2 is a partial exploded perspective view illustrating a plasma display panel according to a preferred embodiment of the present invention.
Figure 3:
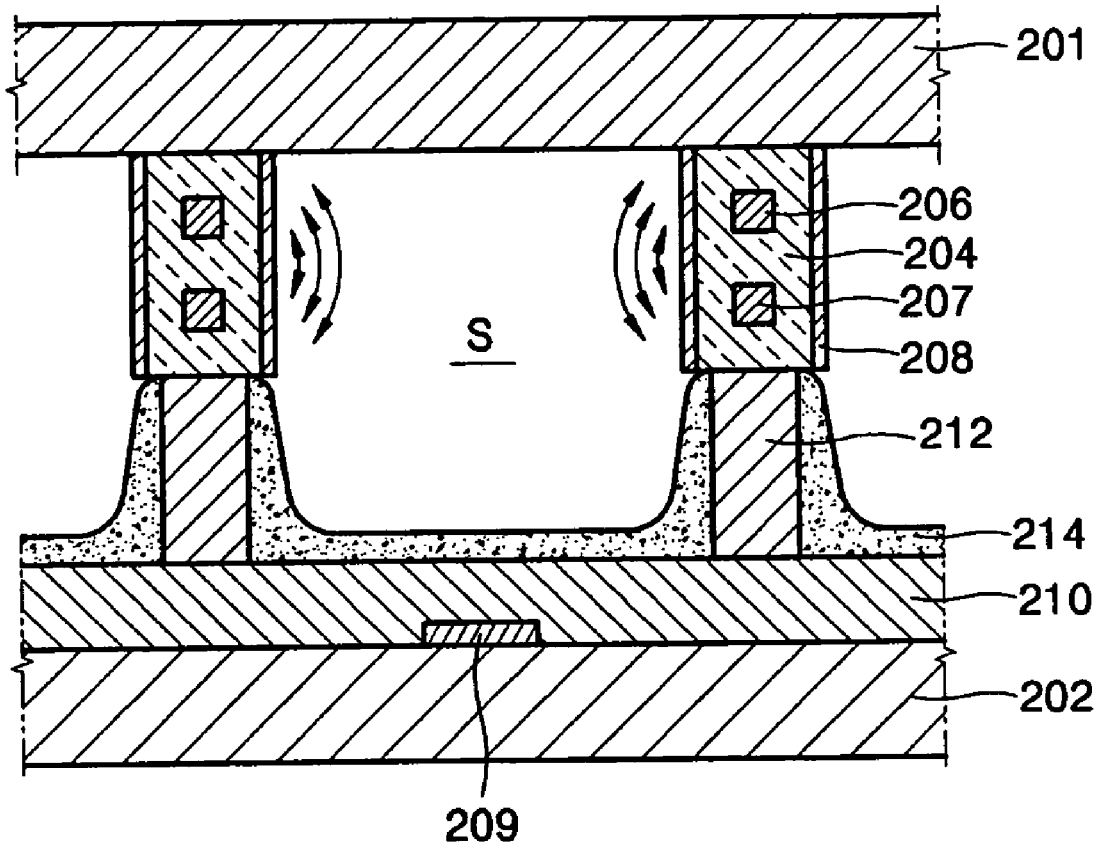
FIG. 3 is a cross-sectional view taken along I—I line of FIG. 2 for a coupled state of the panel.

FIG. 2 is a partial exploded perspective view illustrating a plasma display panel 200 according to a preferred embodiment of the present invention, and FIG. 3 is a cross-sectional view taken along I—I line of FIG. 2 for a coupled state of the panel.

Referring to FIGS. 2 and 3, the plasma display panel 200 comprises a front substrate 201 and a back substrate 202 disposed in parallel with the front substrate 201. Frit glasses are coated at an inner edge opposite to the front and back substrates 201 and 202, respectively, and an internal space is isolated from the outside by sealing the frit glasses to each other.

The front substrate 201 is a transparent substrate consisting of, for example, soda lime glass. The back substrate 202 is composed of substantially the same material as the front substrate 201.

Dielectric walls 205 for defining the discharge cells in cooperation with substrates 201 and 202 are disposed between the front substrate 201 and the back substrate 202. The dielectric walls 205 are made by adding various fillers to paste glass.

The dielectric walls 205 comprise first dielectric walls 203 arranged in the X direction of the front substrate 201 and the back substrate 202, and second dielectric walls 204 arranged in the Y direction. The second dielectric walls 204 are integrally extended in a direction opposite to inner sides of an adjacent pair of first dielectric walls 203. The coupled first and second dielectric walls 203 and 204, respectively, have a matrix shape, and thus the discharge cells have a quadrilateral shape.

As an alternative, the dielectric walls 205 may be made in various other shapes such as a meander, a delta, or a honeycomb, etc. Furthermore, the discharge cells defined by the dielectric walls 205 are not limited to any structure if a suitable structure, such as a hexagon shape, an oval shape, an archetype shape, etc., in addition to the quadrilateral shape, is available to define the discharge cells.

The first discharge electrodes 206 and the second discharge electrodes 207 are buried in the dielectric walls 205. The first and second discharge electrodes 206 and 207, respectively, are arranged around the discharge cells instead of inside the discharge cells. The first and second discharge electrodes 206 and 207, respectively, are electrically insulated from each other, and different intensities of voltages are applied to the discharges electrodes 206 and 207, respectively.

Protective film layers 208, made of a material such as MgO, are deposited on an inner surface of the dielectric walls 205 so that ions generated within the front substrate 201 along four side walls of the discharge cells may emit secondary electrons by interacting with its surface.

The partitioning walls 213 are additionally formed between the dielectric walls 205 and the back substrate 202. The partitioning walls 213 are made of a low dielectric material which is different from that of the dielectric walls 205. The partitioning walls 213 are arranged in substantially the same shape at portions corresponding to the dielectric walls 205.

The partitioning walls 213 comprise first partitioning walls 211 disposed in a direction parallel to the first dielectric walls 203, and second partitioning walls 212 disposed in a direction parallel to the second dielectric walls 204. The first and second partitioning walls 211 and 212, respectively, are integrally coupled to each other, and have a matrix shape.

A single wall has a structure which defines the discharge cells when only the dielectric walls 205 are formed between the front substrate and the back substrate 201 and 202, respectively. A double layer wall made of a material having a different dielectric property has a structure which defines the discharge cells when both the dielectric walls 205 and the partitioning walls 213 are formed between the front substrate and the back substrate 201 and 202, respectively.

Address electrodes 209 are oriented in a direction so as to intersect the first discharge electrodes 206 and the second discharge electrodes 207 on an upper surface of the back substrate 202. The address electrodes 209 are positioned within the discharge cells. The address electrodes 209 are buried by the dielectric layers 210.

The plasma display panel 200 may have a structure of a shape in which only the first discharge electrodes 206 and the second discharge electrodes 207 are intersected, or a structure in which the first discharge electrodes 206, the second discharge electrodes 207, and the address electrodes 209 are arranged, depending on the surface-discharge type, a counter discharge type, or a hybrid type, and each discharge electrode 206 or 207 may be arranged as a single electrode or as a plurality of electrodes.

In the present embodiment, the first discharge electrodes 206 and the second discharge electrodes 207 generate a display sustain discharge. The first discharge electrodes 206 correspond to X electrodes which are discharge sustain electrodes, and the second discharge electrodes 207 correspond to Y electrodes which are scan electrodes. The address electrodes 209 are provided for generating an address discharge in cooperation with the second discharge electrodes 207 in a direction which intersects the first discharge electrodes 206 and the second discharge electrodes 207. At this point, the address electrodes 209 are buried into the dielectric walls 210 comprising material identical to the dielectric walls 205 burying the first and second discharge electrodes 206 and 207, respectively, as well as the back substrate 202.

On the other hand, a discharge gas such as Ne—Xe or He—Xe is injected into the discharge cells defined by the front substrate 201, the back substrate 202, the dielectric walls 205, and the partitioning walls 213.

Furthermore, red, green and blue fluorescent layers 214, which are excited by ultraviolet rays generated from the discharge gas and which emit visible rays, are formed within the discharge cells. At this point, the fluorescent layers 214 can be coated in any area of the discharge cells, but in the present embodiment, they are coated to a predetermined thickness on inside walls of the partitioning walls 213 and on upper surfaces of the dielectric layers 210.

The red, green and blue fluorescent layers 214 are coated for their respective discharge cells. It is preferable that the red fluorescent layers be composed of (Y, Gd) $BO_3$; Eu3+, the green fluorescent layers be composed of $Zn_2SiO_4$:Mn2+, and the blue fluorescent layers be composed of $BaMgAl_{10}O_{17}$:Eu2+.

Means for protecting against over-etching in the developing process, which is among the processes for forming the first discharge electrodes 206 and the second discharge electrodes 207, are provided in accordance with the present invention.

Figure 4:
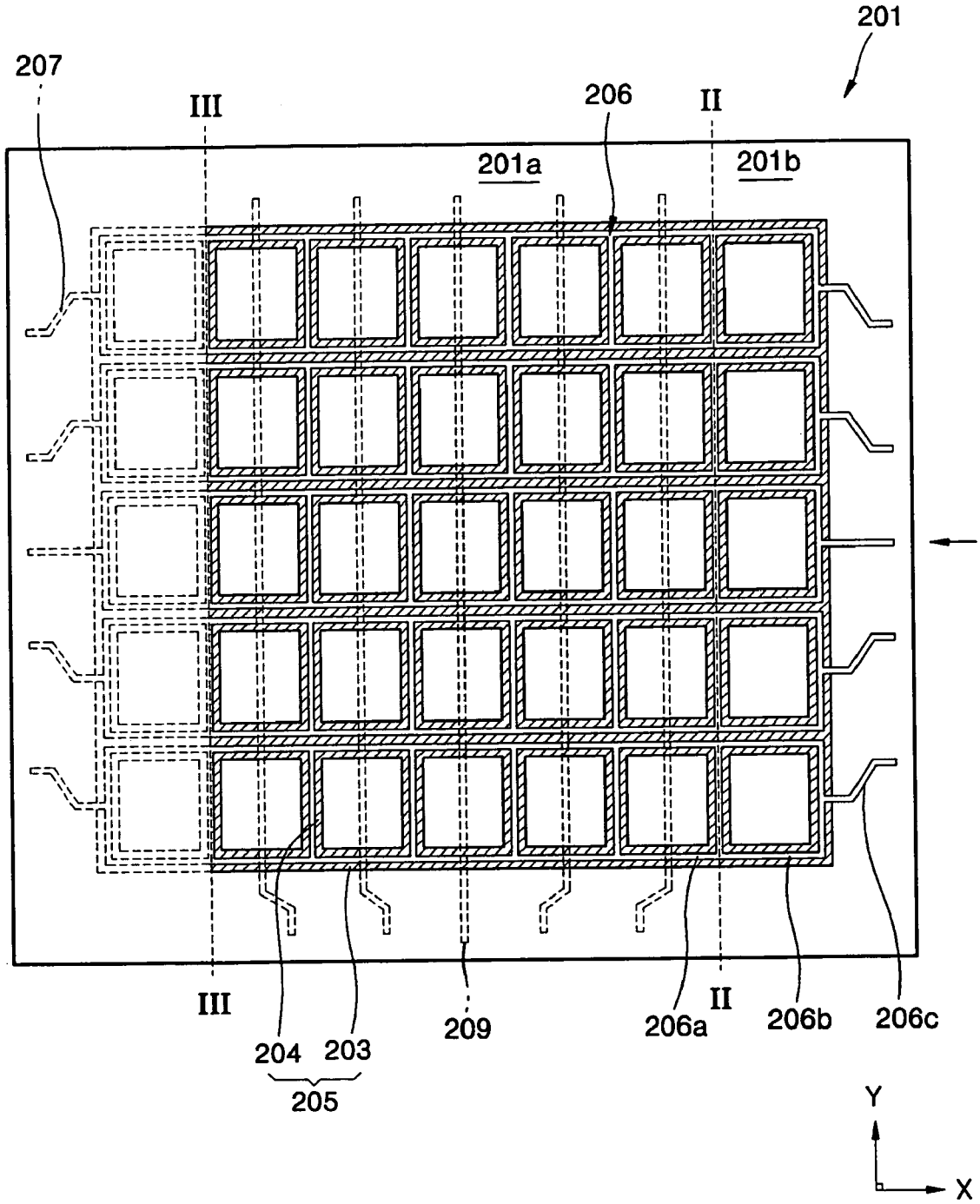
FIG. 4 is a top plan view illustrating a state in which discharge electrodes are arranged in a front substrate as shown in FIG. 2.
Figure 5:
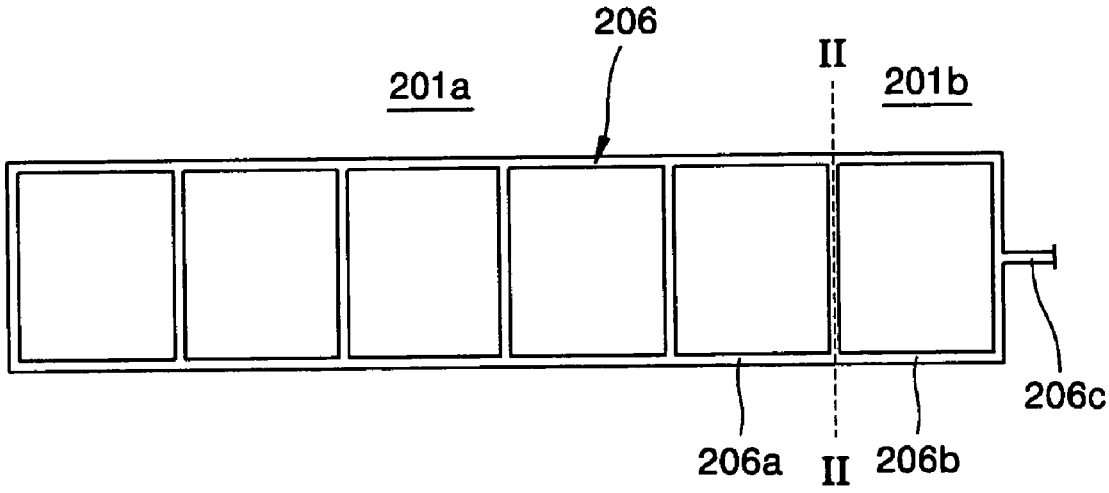
FIG. 5 is an exploded top plan view of one of the discharge electrodes shown in FIG. 4.
Figure 6:
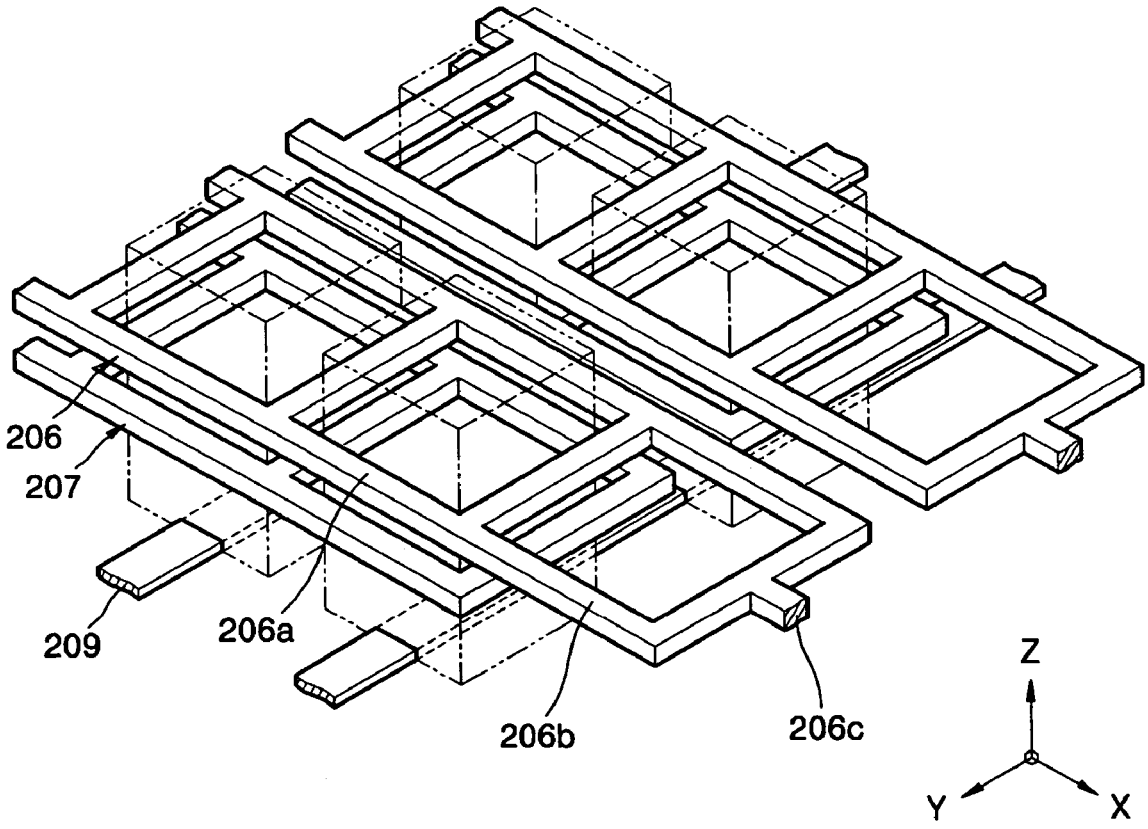
FIG. 6 is an exploded perspective view of the discharge electrodes enclosing the discharge cells shown in FIG. 4.

FIG. 4 is a top plan view illustrating a state in which discharge electrodes are arranged in a front substrate as shown in FIG. 2, FIG. 5 is an exploded top plan view of one of the discharge electrodes shown in FIG. 4, and FIG. 6 is an exploded perspective view of the discharge electrodes enclosing the discharge cells shown in FIG. 4.

Referring to FIGS. 4 and 6, the substrate 201 may be divided into a display area 201*a* for embodying an image and a non-display area 201*b* in which ends of the discharge electrodes 206, 207, arranged along edges of the display area 201*a*, are electrically connected to an outside terminal, for example, a flexible printed cable, depending on a predetermined discharge voltage applied to the discharge electrodes 206, 207.

The display area 201*a* and the non-display area 201*b* are divided by line II—II and line III—III shown in FIG. 4.

The first discharge electrodes 206 are oriented in one direction (X direction) of the substrate 201. The first discharge electrodes 206 are disposed around the discharge cells divided by the dielectric walls 205, and have a quadrilateral shape by means of the dielectric walls 205 of a matrix shape.

Furthermore, the first discharge electrodes 206 are continuously arranged around the discharge cells formed so as to be adjacent in the X direction of the substrate 201. Accordingly, the first discharge electrodes 206 have a trapezoid shape in the X direction of the substrate 201. A plurality of first discharge electrodes 206 having the trapezoid shape are disposed separately at a predetermined distance in the Y direction of the substrate 201.

The second discharge electrodes 207 are separately positioned at a lower part of the first discharge electrodes 206 at positions corresponding to the first discharge electrodes 206 (see FIGS. 2 and 3). The second discharge electrodes 207, like the first discharge electrodes 206, are arranged around the discharge cells, have a trapezoid shape, and are continuously disposed at adjacent discharge cells in the X direction of the substrate 201.

The first discharge electrodes 206 and the second discharge electrodes 207 have substantially the same shape but are connected to outer terminals in the parallel direction of the substrate 201. The first discharge electrodes 206 will be described as an example, but this description is also applicable to the second discharge electrodes 207.

Separate dummy electrodes 206*b* for preventing over-etching are provided on the first discharge electrodes 206. That is, the first discharge electrodes 206 have a trapezoid shape in which a quadrilateral shape is continuously arranged around adjacent discharge cells in the display area 201*a* of the substrate 201. The dummy electrodes 206*b*, integrally extended from the outermost quadrilateral portions 206*a* arranged in the display area 201*a*, are connected to an outside terminal, and are formed in the non-display area 201*b* of the substrate 201.

The dummy electrodes 206*b* are formed by additionally expanding a separate quadrilateral-shape electrode along an exterior of the outermost quadrilateral portions 206*a* positioned at the border of the display area 201*a* and the non-display area 201*b*. The dummy electrodes 206*b* are not limited to any shape but are added in one piece from the outermost quadrilateral portions 206*a*. Terminals 206*c*, connected to an outside connection terminal and having a narrow width, are formed at the exterior of the dummy electrodes 206*b*.

Portions where the dummy electrodes 206*b* are formed are positioned adjacent to the direction in which developing solution is injected from the developer arranged in a developing process, which is one of the processes of producing the first discharge electrodes 206, and are positioned in an area having a width suddenly broadened from a narrow width of terminals 206*c*.

That is, as shown by an arrow in FIG. 4, the right sides of the outermost quadrilateral portions 206*a* arranged adjacent to the developer in the discharge electrodes 206 are exposed for a longer period of time in the developing solution than other portions of the electrodes 206 if the developer is provided on the right side of the substrate 201 and the developing solution is injected from the developer.

Therefore, the dummy electrodes 206*b* are additionally formed at edges of the exterior of the outermost quadrilateral portions 206*a* because the outermost quadrilateral portions 206*a* are apt to be over-etched. Accordingly, the dummy electrodes 206*b* are etched, and the outermost quadrilateral portions 206*a* are not etched, even when the discharge electrodes 206 are substantially exposed to the developing solution, so that a predetermined etching pattern can be obtained.

In the present embodiment, a case of additionally integrally forming the dummy electrodes having a quadrilateral-ring shape at the exterior of the outermost quadrilateral portions 206*a* is described as an example. The shape of dummy electrodes is not limited to the quadrilateral-ring shape if dummy electrodes which have no problem, even though they are etched and removed by over-etching, are formed at the outermost quadrilateral portions 206*a*, as well as the exterior. However, in the present embodiment, the discharge electrodes are not disposed in an area of the dummy electrodes 206*b* arranged in the non-display area 201*b* to prevent the discharge electrodes 206 disposed in the display area 201*a* from being over-etched.

The dummy electrodes 206*b* do not serve as discharge electrodes 206, but are merely electrode patterns to be etched, instead of the discharge electrodes in the developing process. Therefore, it is not required to arrange address electrodes in the space enclosed by the dummy electrodes 206*b*.

The function of the plasma display panel 200 having the above-mentioned structure will be described in detail with reference to FIGS. 2 to 5.

First, the discharge cells to emit light are selected when a predetermined pulse voltage from an external power source is applied between the address electrodes 209 and the second discharge electrodes 207 corresponding to the Y electrodes. The wall charges are stored within the selected discharge cells.

Next, wall charge moves due to a voltage difference applied between the first discharge electrodes 206 and the second discharge electrodes 207 if a "+" voltage is applied to the first discharge electrodes 206 corresponding to the X electrodes and a relatively higher voltage than the "+" voltage is applied to the second discharge electrodes 207.

Subsequently, plasma is generated by collision with discharge gas atoms within the discharge cells due to the movement of the wall charge. The discharge is diffused into the entirety of the discharge cells after starting between the first discharge electrodes 206 and the second discharge electrodes 207 where a relatively strong electric field is formed.

The discharge is no longer generated and space charge and wall charge are formed within the discharge cells if the voltage difference between the first discharge electrodes 206 and the second discharge electrodes 207 is lowered relative to the discharge voltage after the discharge is formed in this way. At this point, discharge again takes place with the help of the wall charge if the polarity of the voltage applied to the first discharge electrodes 206 and the second discharge electrodes 207 is exchanged. The initial discharge process is repeated if the polarity of the first discharge electrodes 206 and the second discharge electrodes 207 is merely exchanged. The discharge takes place in a stable manner by repeating such a process.

At this point, ultraviolet rays generated by the discharge excite fluorescent materials of the fluorescent layers 214 coated in each discharge cell.

Visible rays are obtained through these processes. The generated visible rays are emitted into the discharge cells, and a still image or moving image results.

The process of producing the plasma display panel 200 having such a structure is as follows.

First, the transparent substrate 201 is prepared. After the substrate 201 is prepared, the dielectric walls 205 for dividing the discharge cells along an inner surface of the substrate 201, and the first discharge electrodes 206 and the second discharge electrodes 207 buried into the dielectric walls 205, are alternately formed. Next, the protective film layers 208 formed of MgO are deposited on the inner surface of the dielectric walls 205 in order to increase the emission of secondary electrons.

At this point, a process of forming the first and second discharge electrodes 206 and 207, respectively, is composed of printing and drying processes with respect to raw materials for the discharge electrodes so that the first discharge electrodes 206 and the second discharge electrodes 207 are positioned around the discharge cells divided by the dielectric walls 205. The second discharge electrodes 207 are formed through the same process after forming the first discharge electrodes 206 because the first discharge electrodes 206 and the second discharge electrodes 207 are vertically and separately arranged within the dielectric walls 205.

When the first discharge electrodes 206 and the second discharge electrodes 207 have gone through a drying process, the electrodes 206 and 207 are developed after mask alignment, exposure to light, and patterning in a quadrilateral shape which is continuously arranged around the discharge cells. The developer is arranged so as to be adjacent to one edge of the substrate 201 in the developing process, and shapes of the first discharge electrodes 206 and the second discharge electrodes 207 are developed by injecting the developing solution onto the substrate 201 from the nozzle. Next, the formation of the first discharge electrodes 206 and the second discharge electrodes 207 is completed through a plastic process carried out at a predetermined temperature.

The first discharge electrodes 206 and the second discharge electrodes 207 have a trapezoid shape in which a quadrilateral shape is continuously arranged across adjacent discharge cells in the X direction of the substrate 201, and are integrally formed by extending the dummy electrodes 206*b* arranged in the non-display area 201*b* of the substrate 201 to the non-display area at the outermost quadrilateral portions 206*a* of the discharge electrodes 206 arranged in the display area 201*a*. Therefore, the dummy electrodes 206*b* are etched, and the discharge electrodes 206 arranged in the display area 201*a* are protected from over-etching, even if over-etching takes place in the developing process. That is, the dummy electrodes 206*b* are etched instead of the outermost quadrilateral portions, even if over-etching takes place in the dummy electrodes 206*b* instead of the discharge electrodes 206, more specifically, in the outermost quadrilateral portions 206*a*.

Specifically, the dummy electrodes 206*b* are arranged in the non-display area 201*b* exposed to the developing solution injected from the developer for a relatively long period of time. Therefore, only dummy electrodes 206*b* which play a role in compensating for over-etching, instead of a role of the discharge electrodes 206, are etched even though over-etching takes place in the non-display area. Thus, the discharge electrodes 206 within the display area 201*a* are formed in the predetermined pattern.

Accordingly, the shapes of the outermost quadrilateral portions 606*a* can be desirably maintained because the dummy electrodes 206*b* are arranged, even though portions are exposed to the developing solution injected from the nozzle of the developer for a long period of time.

In the plasma display panel according to the present invention, the discharge electrodes 206 are protected from over-etching, even though the discharge electrodes 206 are exposed for a long period of time to the developing solution injected from the developer, by forming the dummy electrodes 206*b* not involved in the discharge at outer portions of the discharge electrodes 206*b* corresponding to the injection direction of the developer, so that it is possible to form the discharge electrodes 206*b* having a predetermined thickness or shape. Therefore, it is possible to prevent in advance defects such as disconnection.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a plurality of substrates including a front substrate and a back substrate disposed opposite to each other;

dielectric walls arranged between a front surface and a back surface, and defining discharge cells in cooperation with the front substrate and the back substrate;

first and second discharge electrodes separately arranged around the discharge cells and buried into the dielectric walls;

dummy electrodes formed at outer portions of the discharge electrodes arranged on at least one side of the substrate;

address electrodes provided on the back substrate;

red, green and blue color fluorescent layers coated within the discharge cells; and partitioning walls disposed between the dielectric walls and the back substrate, and which combine with the dielectric walls to define the discharge cells;

wherein the dielectric walls are made of a first dielectric material and the partitioning walls are made of a second dielectric material which is different from the first dielectric material;

wherein the dummy electrodes are integrally extended at each edge of outermost portions of the first and second discharge electrodes.

2. The plasma display panel according to claim 1, wherein the dummy electrodes are arranged in a non-display area of the substrates in which the first and second discharge electrodes are connected to outside terminals.

3. The plasma display panel according to claim 2, wherein the first and second discharge electrodes are disposed so as to enclose adjacent discharge cells along one direction of the substrates, and the first and second discharge electrodes are respectively continuously connected around the adjacent discharge cells.

4. The plasma display panel according to claim 3, wherein the dummy electrodes are disposed at outermost portions of the first and second discharge electrodes continuously arranged in one direction of the substrates.

5. The plasma display panel according to claim 2, wherein the dummy electrodes are formed so as to be adjacent to a developer arranged in one direction of the substrates during a developing process, and are formed at outer portions of the first and second discharge electrodes exposed to developing solution for a relatively long period of time.

6. The plasma display panel according to claim 2, wherein the first and second discharge electrodes have a ladder shape continuously arranged around adjacent discharge cells in one direction of the substrates.

7. The plasma display panel according to claim 2, wherein the address electrodes are disposed in a direction so as to intersect the first and second discharge electrodes, the address electrodes being buried by dielectric layers.

8. The plasma display panel according to claim 1, wherein fluorescent layers are coated inside the partitioning walls.

9. The plasma display panel according to claim 1, wherein the address electrodes are disposed in a direction so as to intersect the first and second discharge electrodes, the address electrodes being buried by dielectric layers.

10. The plasma display panel according to claim 1, wherein the second dielectric material is a low dielectric material.

* * * * *